US010914526B2

(12) United States Patent
Steinbauer et al.

(10) Patent No.: US 10,914,526 B2
(45) Date of Patent: Feb. 9, 2021

(54) COILED HEAT EXCHANGER HAVING INSERTS BETWEEN THE SHROUD AND THE LAST PIPE LAYER

(71) Applicant: LINDE AKTIENGESELLSCHAFT, Munich (DE)

(72) Inventors: Manfred Steinbauer, Raisting (DE); Christiane Kerber, Pocking (DE); Jurgen Spreemann, Rosenheim (DE); Ingomar Blum, Tacherting (DE); Florian Deichsel, Munich (DE); Konrad Braun, Lenggries (DE); Roland Hiller, Garching Alz (DE); Alexander Kern, Trostberg (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 66 days.

(21) Appl. No.: 16/300,368

(22) PCT Filed: May 11, 2017

(86) PCT No.: PCT/EP2017/025120
§ 371 (c)(1),
(2) Date: Nov. 9, 2018

(87) PCT Pub. No.: WO2017/194202
PCT Pub. Date: Nov. 16, 2017

(65) Prior Publication Data

US 2019/0137185 A1 May 9, 2019

(30) Foreign Application Priority Data

May 12, 2016 (DE) ..... 10 2016 005 838

(51) Int. Cl.
*F28D 7/02* (2006.01)
*F28F 9/00* (2006.01)

(52) U.S. Cl.
CPC ..... *F28D 7/024* (2013.01); *F28F 9/005* (2013.01); *F28F 2235/00* (2013.01); *F28F 2240/00* (2013.01)

(58) Field of Classification Search
CPC ... F28F 2009/224; F28F 2250/02; F28D 3/02; F28D 7/024; F28D 2021/0033;
(Continued)

(56) References Cited

U.S. PATENT DOCUMENTS 1,526,320 A * 2/1925 Cook ..... F28D 7/024 165/113
2,160,898 A * 6/1939 Peff ..... F25J 5/002 62/643

(Continued)

FOREIGN PATENT DOCUMENTS

DE 10 2012 014101 A1 1/2014
DE 10 2012 014391 A1 1/2014
EP 1 790 932 A1 5/2007

OTHER PUBLICATIONS

International Search Report for PCT/EP2017/025120 dated Aug. 18, 2017.

(Continued)

*Primary Examiner* — Jianying C Atkisson
*Assistant Examiner* — Jose O Class-Quinones
(74) *Attorney, Agent, or Firm* — Millen White Zelano & Branigan, PC; Brion P. Heaney

(57) ABSTRACT

A heat exchanger, providing indirect heat transfer between a first fluid and at least one second fluid, comprises a jacket enclosing a jacket space for accommodating the first fluid and a tube bundle arranged in the jacket space and having a plurality of tubes for accommodating the at least one second fluid. The tubes form multiple tube layers. A shroud arranged in the jacket space encloses an outermost tube layer of the tube bundle. Spacers extending along the longitudinal axis (Continued)

are arranged between the shroud and the outermost tube layer. An interspace is present between any two spacers adjacent in the circumferential direction of the shroud, and between the shroud and the uppermost tube layer. A flow obstruction is arranged in the respective interspace and is designed to prevent or suppress a flow of the first fluid in the respective interspace, at least over a part section thereof.

18 Claims, 2 Drawing Sheets

(58) Field of Classification Search
CPC .. F28D 2021/0064; F28D 1/0472; F28D 7/04; F25J 5/002
See application file for complete search history.

(56) References Cited

U.S. PATENT DOCUMENTS 2,668,692 A * 2/1954 Hammell ..... F28D 7/024 165/156
2,737,789 A * 3/1956 Ruff ..... F28D 5/02 62/305
3,256,932 A * 6/1966 Schlichting ..... F22B 1/063 165/163
3,509,939 A * 5/1970 Max ..... F22B 21/26 165/162
4,131,085 A * 12/1978 McDonald ..... F22B 37/483 122/382
4,163,470 A * 8/1979 Johnsen ..... F22B 1/063 122/32
4,201,262 A * 5/1980 Goldstein ..... F28D 3/04 165/117
4,215,745 A * 8/1980 Tuckmantel ..... F28F 9/005 165/160
4,263,260 A * 4/1981 Brautigam ..... B01J 8/0285 165/156
4,294,312 A * 10/1981 Kehrer ..... F28F 9/22 165/134.1
4,307,685 A * 12/1981 Robin ..... F22B 1/063 122/32
4,313,491 A * 2/1982 Molitor ..... F28D 7/024 165/83
4,402,793 A * 9/1983 Petrek ..... B01D 1/22 202/174
4,451,960 A * 6/1984 Molitor ..... B21D 53/027 165/165
4,605,059 A * 8/1986 Page ..... F28D 7/024 165/163
4,737,337 A * 4/1988 Garabedian ..... F22B 1/066 165/70
4,781,033 A * 11/1988 Steyert ..... F17C 3/085 165/10
4,981,169 A * 1/1991 Eisinger ..... F28F 9/013 165/162
5,487,423 A * 1/1996 Romero ..... F28D 7/024 165/156
5,572,885 A * 11/1996 Erickson ..... F25B 15/02 62/484
5,713,216 A * 2/1998 Erickson ..... F28D 7/024 62/476
6,463,757 B1 * 10/2002 Dickson ..... F25B 40/00 29/890.06
6,499,534 B1 * 12/2002 Tawney ..... F28D 7/024 165/156
8,327,923 B2 * 12/2012 Steinbauer ..... F25J 5/002 165/135
2009/0218075 A1 9/2009 Schoenberger
2013/0068431 A1 * 3/2013 Ho ..... F25J 1/0262 165/163
2014/0054015 A1 * 2/2014 Boehm ..... B21D 11/06 165/172
2015/0204614 A1 * 7/2015 Bunce ..... F28F 9/0131 165/164

OTHER PUBLICATIONS

English Abstract for DE-102012014101, Publication Date: Jan. 23, 2014.
English Abstract for DE-102012014391, Publication Date: Jan. 23, 2014.

* cited by examiner

COILED HEAT EXCHANGER HAVING INSERTS BETWEEN THE SHROUD AND THE LAST PIPE LAYER

The invention relates to a heat exchanger according to claim 1 and to a method for arranging flow obstacles in a heat exchanger according to claim 14.

Such a heat exchanger has a pressure-bearing shell, which extends along a preferably vertically oriented longitudinal axis and bounds a shell space for receiving a first fluid. A bundle of tubes comprising a plurality of tubes for receiving at least one second fluid is arranged in the shell space, wherein the tubes form a number of tube layers of the bundle of tubes that are arranged one above the other in the radial direction of the bundle of tubes. The at least one second fluid can consequently enter into an indirect heat exchange with the first fluid carried in the shell space. Such a heat exchanger also has a shroud, which is arranged in the shell space, surrounds the bundle of tubes and preferably takes the form of a cylinder jacket, wherein spacers that are made to extend parallel to the longitudinal axis are arranged between the shroud and the outermost tube layer. By means of the spacers, which can be used to fix the shroud on the outermost tube layer, in particular thermally induced stresses between the shroud and the bundle of tubes can be reduced. For this purpose, the spacers may be formed as elastically deformable in the radial direction of the bundle of tubes. However, on account of the spacers, between every two spacers adjacent to one another in the circumferential direction of the shroud and the shroud and the uppermost tube layer there is a small intermediate space, which in particular has in each case the form of a partial shell of the cylinder jacket. These intermediate spaces reduce the effect of the shroud, which is that of suppressing an excessive bypass flow of the first fluid past the bundle of tubes, since such flows would have an adverse effect on the effectiveness of the heat exchanger. On the one hand, in the case of a falling film evaporator, an excessive bypass flow may lead to an increased occurrence of liquid in the sump of the heat exchanger. If that makes the liquid level rise too high, the output of such a heat exchanger must be reduced or the liquid (first fluid) must be extracted from the system, in order in particular to prevent a shutdown of the installation. On the other hand, because of this bypass flow, the exchanged heat output of the exchanger may be reduced.

On this basis, the present invention therefore addresses the problem of providing a heat exchanger and a method that reduce the disadvantage described at the beginning of a bypass flow.

This problem is solved by a heat exchanger with the features of claim 1 and by a method with the features of claim 14. Advantageous refinements of these aspects of the present invention are specified in the corresponding subclaims and will be described below.

According to claim 1, it is provided according to the invention that a flow obstacle is arranged in the respective intermediate space and is designed to hinder or suppress a flow of the first fluid in the respective intermediate space at least over a partial portion of the respective intermediate space that is made to extend along the longitudinal axis.

According to a preferred embodiment of the heat exchanger according to the invention, it is also provided that the respective intermediate space has a cross-sectional area perpendicularly to the longitudinal axis, wherein, along its entire length in the direction of the longitudinal axis, the respective flow obstacle takes up over 50%, preferably over 60%, preferably over 70%, preferably over 80%, preferably over 90%, preferably over 95%, preferably over 99%, in particular 100%, of the cross-sectional area of the assigned intermediate space.

According to a preferred embodiment of the heat exchanger according to the invention, it is also provided that the flow obstacle comprises a flexible layer of material, so that it can be placed around a comparatively more rigid support structure, for example produced from a metal. According to preferred embodiments, such a layer of material may for example have a modulus of elasticity in compression (for example in accordance with DIN EN ISO 604) of less than 10000 MPa (MegaPascals), preferably of less than 2000 MPa, particularly preferably of less than 1000 MPa, more particularly preferably in the range from 100 to 1000 MPa and in particular particularly preferably in the range from 300 to 1000 MPa.

According to one embodiment, the flexible layer of material may comprise PTFE (polytetrafluoroethylene) or be formed from PTFE.

In order in particular to make it easier for the respective flow obstacle to be pushed into the assigned intermediate space, according to one embodiment it is preferably provided that the respective flow obstacle has a supporting structure. Here, the supporting structure may also be integrally formed on the layer of material, or the layer of material may be integrally formed on the supporting structure.

Here, the supporting structure may for example be formed in the manner of a plate. If the distance between adjacent spacers in the circumferential direction of the shroud is sufficiently small, the supporting structure may for example be formed as a flat or planar plate, in particular as a metal sheet. When there are greater distances between adjacent spacers, from one to the other, such a supporting structure may also have a curvature that corresponds to a curvature of the outermost tube layer in the circumferential direction of the shroud or follows the same path.

In principle, the supporting structure according to one embodiment may comprise metal or may be formed from a metal.

Furthermore, according to a preferred embodiment of the heat exchanger according to the invention, it is provided that, with respect to a vertically aligned longitudinal axis of the shell, the layer of material of the respective flow obstacle is placed or guided (for example when there is an integrally formed supporting structure/layer of material, see above) around an upper edge of the supporting structure of the flow obstacle, so that the layer of material at least in certain portions, preferably completely, covers this upper edge and a front side of the supporting structure and a rear side of the supporting structure facing away from the front side. The front side of the respective supporting structure is in this case facing the shroud and facing away from the outermost tube layer.

Furthermore, according to a preferred embodiment of the heat exchanger according to the invention, it is provided that, with respect to a vertically aligned longitudinal axis of the shell, the respective flow obstacle is in each case pushed into the respective intermediate space from below. This allows in particular an already constructed heat exchanger also to be retrofitted with a flow obstacle according to the invention (also see below). Here, for example, an existing opening in the shell of the heat exchanger, for example in the form of a manhole, may be used to obtain access to the heat exchanger.

Furthermore, according to a preferred embodiment of the heat exchanger according to the invention, it is provided that the respective flow obstacle is pushed into the assigned intermediate space, or arranged there, with a portion of the layer of material that is placed around the upper edge out in front. The supporting structure advantageously serves here for stiffening the layer of material, which is preferably configured to seal off the respective intermediate space. In this way, a comparatively extremely flexible sealing material or a corresponding layer of material can also be pushed into the comparatively narrow intermediate space between the shroud and the outermost tube layers. Preferably, the supporting structure remains in the heat exchanger. However, it is also conceivable in principle to use the supporting structure merely as a positioning aid and to remove it again after arranging the respective layer of material.

With regard to the sealing of the existing intermediate spaces, it is in particular important to protect a lower portion of the bundle of tubes from bypass flows. According to one embodiment of the heat exchanger according to the invention, it is therefore provided that, with respect to a vertical alignment of the longitudinal axis of the shell, the respective flow obstacle only extends along a lower portion of the bundle of tubes in the respective intermediate space. This lower portion extends in particular in an upward direction from a lowermost end of the bundle of tubes (with respect to a heat exchanger arranged ready for operation, in the case of which the longitudinal axis extends parallel to the vertical). This lower portion preferably has in this case an extent or length in the direction of the longitudinal axis that is in particular less than 50%, 30%, 20%, 10% or 5% of the overall length of the bundle of tubes along the longitudinal axis.

Furthermore, according to one embodiment of the invention, it is provided that the respective flow obstacle extends in the circumferential direction of the shroud over the entire circumferential extent of the respective intermediate space between the spacers, and completely fills the respective intermediate space, in particular also in the radial direction. This allows a flow in the respective intermediate space to be suppressed at least over the partial portion of the intermediate space over which the respective flow obstacle extends along the longitudinal axis.

Furthermore, according to a preferred embodiment of the heat exchanger according to the invention, it is provided that, for forming the tube layers, the tubes are in each case coiled helically onto or around a core tube of the heat exchanger that is designed for the purpose of absorbing the load of the tubes. Here, it is preferably provided that the heat exchanger has further spacers between the respective tube layer and the tube layer lying thereunder in each case, arranged further inward in the radial direction, wherein the spacers extend in each case along the longitudinal axis. The individual tube layers are in this case preferably supported on the tube layer respectively arranged thereunder by way of a constant number of spacers per tube layer, and consequently ultimately on the core tube. The latter preferably extends along the longitudinal axis of the shell and furthermore is preferably arranged coaxially in relation to the shell in the shell space.

Said spacers are preferably in each case arranged in the radial direction exactly over an assigned spacer lying thereunder. Furthermore, the outermost spacers (in the radial direction of the bundle of tubes) are preferably formed as elastically deformable in the radial direction. So that they can compensate for thermally induced stresses between the shroud and the bundle of tubes. For this purpose, the spacers may be produced from a corresponding material or have separate spring means (for example helical springs).

A further aspect of the invention relates to a method for arranging, in particular retrofitting, flow obstacles in a heat exchanger, which has a shell that is made to extend along a longitudinal axis and surrounds a shell space for receiving a first fluid, wherein the heat exchanger also has a bundle of tubes arranged in the shell space and comprising a plurality of tubes for receiving at least one second fluid, which form a number of tube layers, and also a shroud, which is arranged in the shell space and encloses an outermost tube layer of the bundle of tubes in the radial direction of the bundle of tubes, wherein spacers that are made to extend along the longitudinal axis are arranged between the shroud and the outermost tube layer, wherein between every two spacers adjacent to one another in the circumferential direction of the shroud and the shroud and the uppermost tube layer there is an intermediate space, and wherein a flow obstacle is pushed into the respective intermediate space and is designed to hinder or suppress a flow of the first fluid along the longitudinal axis in the respective intermediate space at least over a partial portion of the respective intermediate space that is made to extend along the longitudinal axis.

In individual embodiments of the method according to the invention, the flow obstacles may be designed in the ways described above.

The flow obstacles are in each case preferably inserted into the respective intermediate space from below and then pushed in the upward direction along the (preferably vertical) longitudinal axis in the shell of the heat exchanger.

As already mentioned above, according to one embodiment of the method, an already operationally ready heat exchanger is retrofitted in this way for better suppression of the bypass flows in the intermediate spaces.

In particular, the respective flow obstacle, which is preferably pushed in along the longitudinal axis from below into a lower portion of the respective intermediate space, has a supporting structure with an upper edge, around which a layer of material is placed (the layer of material may also be integrally formed on the supporting structure, see above), so that a portion of the layer of material surrounds this upper edge, wherein the flow obstacle is pushed into the respective intermediate space from below with this portion out in front. The layer of material or the supporting structure may comprise the materials respectively described above or be formed from the materials respectively described above.

BRIEF DESCRIPTION OF THE DRAWINGS

Further details and advantages of the invention are to be explained by the following description of the figures of an exemplary embodiment by reference to the figures:

in which:

FIG. 1 shows in conjunction with FIGS. 2 and 3 an embodiment of a heat exchanger 1 according to the invention with a plurality of flow obstacles 300.

Figure 1:
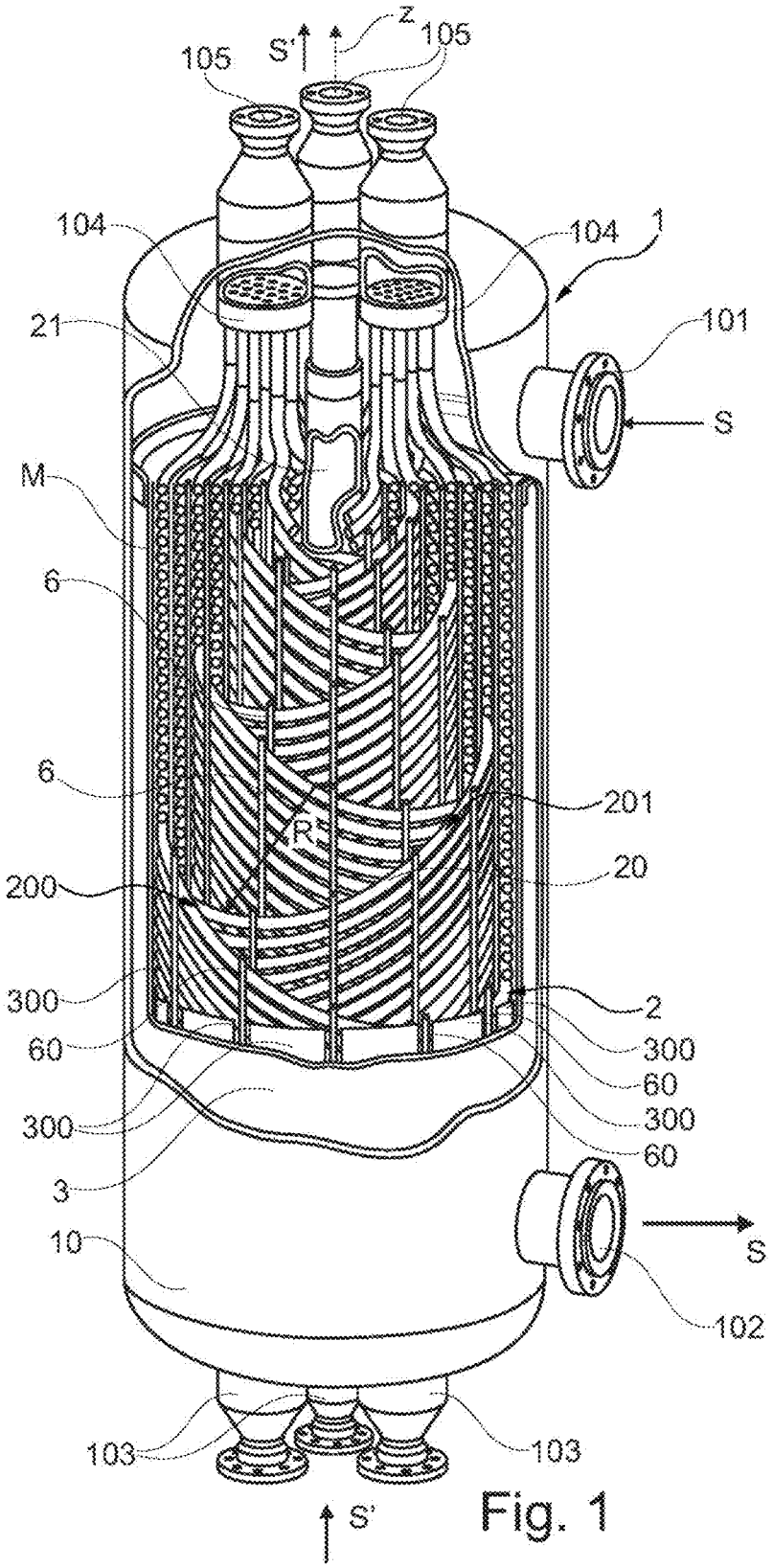
FIG. 1 shows a sectional view in the manner of a detail of a heat exchanger according to the invention.

The heat exchanger 1 is designed for the indirect exchange of heat between a first fluid S and at least one second fluid S' and has a shell 10, which surrounds a shell space M for receiving the first fluid S, which can be introduced into the shell space M by way of an inlet nozzle 101 on the shell 10 and can be drawn off again from the shell space M by way of a corresponding outlet nozzle 102 on the shell 10, wherein the first fluid S acts from above on a bundle of tubes 2 of the heat exchanger arranged in the shell space M.

The shell 10 of the heat exchanger 1 extends along a longitudinal axis z, which runs along the vertical with respect to a state of the heat exchanger 1 arranged as intended. The bundle of tubes 2 has a plurality of tubes 20 for receiving the at least one second fluid S'. Various second fluids S' may be carried in assigned tubes or groups of tubes of the bundle of tubes 2, i.e. the bundle of tubes 2 is divided in a way corresponding to the number of second fluids S' to be carried. The tubes 20 are coiled helically onto a core tube 21 so as to form a number of layers of tubes 200, 201, which are arranged one above the other in a radial direction R, which is perpendicular to the longitudinal axis z, wherein the core tube 21 likewise extends along the longitudinal axis z and is arranged concentrically in the shell space M. Furthermore, the individual tube layers 200, 201 are fixed to one another by way of spacers 6 made to extend along the longitudinal axis z, wherein in each case a number of spacers 6 are arranged one above the other in the radial direction R of the bundle of tubes 2. In this case, a constant number of spacers 6 is preferably provided between the adjacent tube layers.

A number of tubes 20 may be respectively brought together in a tubesheet 104, wherein the second fluid S' or a number of second fluids S' can be introduced into each tube 20 by way of inlet nozzles 103 on the shell 10 and can be drawn off from the tubes 20 by way of outlet nozzles 105. Consequently, heat can be exchanged indirectly between the first fluid S and the at least one second fluid S', wherein these fluids S, S' are for example passed through the heat exchanger 1 in countercurrent.

The shell 10 and the core tube 21 are at least in certain portions configured in the form of a cylinder, so that the longitudinal axis z forms a cylinder axis of the shell 10 and of the core tube 21 running concentrically therein. Also arranged in the shell space M is a preferably hollow-cylindrically formed shroud 3, which encloses the bundle of tubes 2, so that an annular gap surrounding the bundle of tubes 2 is formed between the bundle of tubes 2 and each shroud 3. Arranged in this gap are spacers 60, which are made to extend along the longitudinal axis z and are used to fix the shroud 3 to the bundle of tubes 2, in particular to the outermost tube layer 200. Said spacers 60 preferably extend along the longitudinal axis z over the entire length of the bundle of tubes 2 and are in each case preferably formed so as to be elastically deformable in the radial direction R, in order to be able to compensate for thermally induced stresses between the bundle of tubes 2 and the shroud 3. On account of the spacers 60, between the shroud 3 and the outermost tube layer 200 there is between every two spacers 60 adjacent to one another in the circumferential direction U of the shroud 3 an intermediate space M', which is made to extend along the longitudinal axis z.

Preferably arranged in these intermediate spaces M' are flow obstacles 300, which in the ideal case completely prevent a bypass flow of the first fluid S in the intermediate spaces M' in the region of the flow obstacles 300, or in particular at least hinder these flows in such a way that a significant increase in the effectiveness of the heat exchanger 1 is achieved, or it is provided that at least part of the fluid S (preferably the entire fluid S) is returned into the bundle 2 from the respective intermediate space M'.

Figure 2:
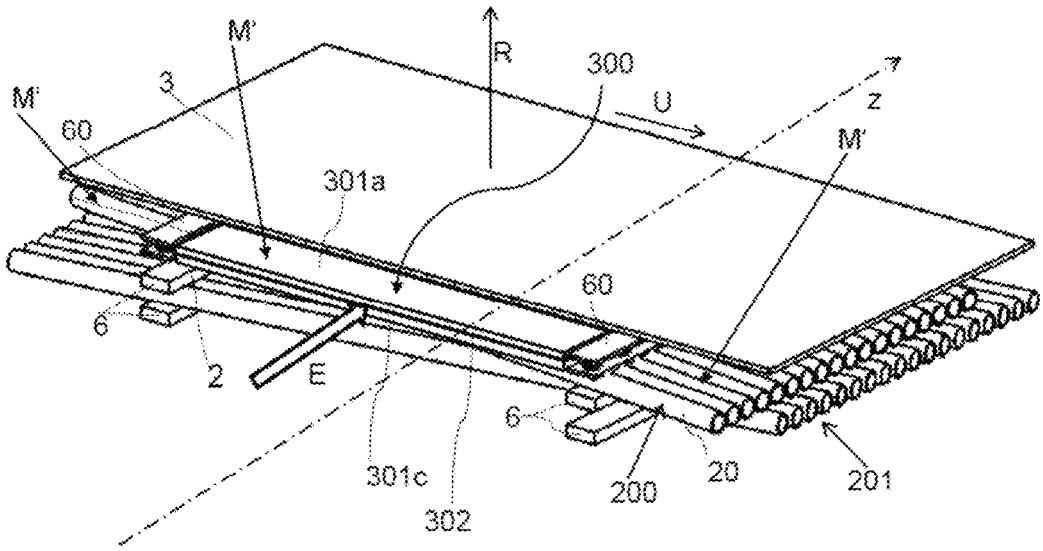
FIG. 2 shows a partially sectioned and perspective view in the manner of a detail of an upper tube layer of a heat exchanger according to the invention, wherein a shroud is arranged on the uppermost tube layer and is fixed to the uppermost tube layer by way of spacers, wherein flow obstacles are provided between the shroud and the uppermost tube layer (for the sake of overall clarity, only one flow obstacle is shown in FIG. 2)
Figure 3:
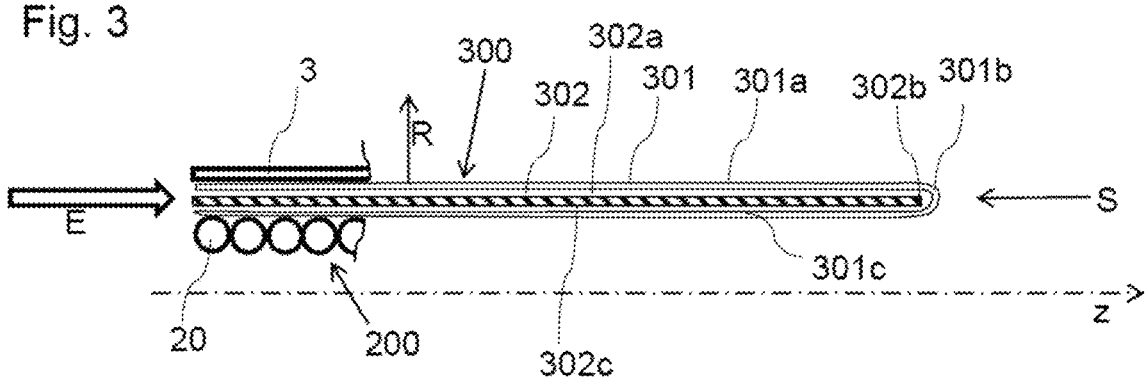
FIG. 3 shows a sectional view of a flow obstacle according to the invention in the manner of FIG. 2.

According to one embodiment, the flow obstacles 300 have a supporting structure 302 (for example in the form of a rectangular metal sheet) and a layer of material 301, which for example consists of PTFE and is placed around an upper edge 302*b* of the supporting structure 302, so that the layer of material 301 covers this upper edge 302*b* and a front side 302*a* of the supporting structure 302 that is facing the shroud 3 and a rear side 302*c* of the supporting structure 302 that is facing away from the front side 302*a* with corresponding portions 301*a*, 301*b*, 301*c*. Here, the supporting structure 302 serves for stiffening the layer of material 301 of the respective flow obstacle 300, which is inserted, preferably in each case from below, in a direction of insertion E (cf. FIGS. 2 and 3) with the portion 301*b* that has been placed around the respective upper edge 302*b* into the assigned intermediate space M' and pushed in the upward direction. For example in the case of an upright heat exchanger 1, here the direction of insertion E points upward in the vertical direction along the longitudinal axis z. The flow obstacles 300 may of course also be introduced into a heat exchanger 1 that is lying down, wherein the direction of insertion E is correspondingly oriented horizontally in each case. Preferably, the respective flow obstacle 300, arranged as intended, tightly fills at least a lower portion of the respective intermediate space M', and consequently preferably prevents a bypass flow of the first fluid S past the bundle of tubes 2 in this region.

Such sealing can be advantageously provided as a retrofit on already existing helically coiled heat exchangers 1.

| List of reference signs | |
|---|---|
| 1 | Heat exchanger |
| 2 | Bundle of tubes |
| 3 | Shroud |
| 6 | Spacer |
| 10 | Shell |
| 20 | Tubes |
| 21 | Core tube |
| 60 | Outermost spacers |
| 101 | Inlet nozzle |
| 102 | Outlet nozzle |
| 103 | Inlet nozzle |
| 104 | Tubesheet |
| 105 | Outlet nozzle |
| 200 | Outermost tube layer |
| 201 | Tube layer |
| 300 | Flow obstacle |
| 301 | Layer of material |
| 301a, 301b, 301c | Portions of layer of material |
| 302 | Supporting structure |
| 302a | Front side |
| 302b | Upper edge |
| 302c | Rear side |
| E | Direction of insertion |
| R | Radial direction |
| Z | Longitudinal axis |
| M | Shell space |
| M' | Intermediate space |
| U | Circumferential direction |

The invention claimed is:

1. A heat exchanger for the indirect exchange of heat between a first fluid and at least one second fluid comprising:

a shell which extends along a longitudinal axis and surrounds a shell space for receiving the first fluid, a bundle of tubes, arranged in the shell space, comprising a plurality of tubes for receiving the at least one second fluid, wherein the tubes form a number of tube layers, and a shroud which is arranged in the shell space and encloses an outermost tube layer of the bundle of tubes in the radial direction of the bundle of tubes, wherein spacers that extend along the longitudinal axis are arranged between the shroud and the outermost tube layer, and wherein between every two spacers adjacent to one another in the circumferential direction of the shroud and the shroud and the outermost tube layer there is an intermediate space that extends along the longitudinal axis, wherein a flow obstacle is arranged in each intermediate space and is designed to hinder or suppress a flow of the first fluid in the intermediate space at least over a partial portion of the intermediate space that extends along the longitudinal axis, and wherein each flow obstacle comprises a flexible layer of material, and wherein each intermediate space has a cross-sectional area perpendicularly to the longitudinal axis and a length along the direction of the longitudinal axis, and wherein, along the length in the direction of the longitudinal axis the respective flow obstacle takes up over 50% of the cross-sectional area of the intermediate space.

2. The heat exchanger as claimed in claim 1, wherein the respective flow obstacle extends in the circumferential direction of the shroud over the entire circumferential extent of the respective intermediate space between the spacers.

3. The heat exchanger as claimed in claim 1, wherein the flexible layer of material comprises polytetrafluoroethylene or is formed from polytetrafluoroethylene.

4. The heat exchanger as claimed in claim 1, wherein each flow obstacle has a supporting structure.

5. The heat exchanger as claimed in claim 4, wherein the supporting structure is formed in the manner of a plate.

6. The heat exchanger as claimed in claim 4, wherein the supporting structure comprises a metal or is formed from a metal.

7. The heat exchanger as claimed in claim 4, wherein each supporting structure has an upper edge, a front side, and a rear side which faces away from the front side of the supporting structure, and wherein the flexible layer of material is placed or guided around the upper edge of the supporting structure so that the flexible layer of material at least partially covers the upper edge, the rear side and the front side of the supporting structure.

8. The heat exchanger as claimed in claim 4, wherein the supporting structure is integrally formed on the flexible layer of material or the flexible layer of material is integrally formed on the supporting structure.

9. The heat exchanger as claimed in claim 4, wherein the respective flow obstacle is arranged in the assigned intermediate space with a portion of the flexible layer of material placed or guided around an upper edge of the supporting structure.

10. The heat exchanger as claimed in claim 4, wherein the flexible layer of material having a modulus of elasticity in compression in the range from 100 to 1000 MPa.

11. The heat exchanger as claimed in claim 1, wherein the respective flow obstacle only extends along a lower portion of the bundle of tubes in the respective intermediate space.

12. The heat exchanger as claimed in claim 1, wherein, for forming the tube layers, the tubes are in each case coiled onto a core tube of the heat exchanger that is designed for absorbing the load of the tubes, wherein the heat exchanger has further spacers between the respective tube layer and the tube layer lying thereunder in each case, arranged further inward in the radial direction, wherein said further spacers extend in each case along the longitudinal axis.

13. The heat exchanger as claimed in claim 1, wherein the flow obstacle takes up over 60% of the cross-sectional area of the intermediate space.

14. The heat exchanger as claimed in claim 1, wherein the respective flow obstacle takes up over 70% of the cross-sectional area of the intermediate space.

15. The heat exchanger as claimed in claim 1, wherein respective flow obstacle takes up over 80% of the cross-sectional area of the intermediate space.

16. The heat exchanger as claimed in claim 1, wherein respective flow obstacle takes up over 90% of the cross-sectional area of the intermediate space.

17. A method for arranging flow obstacles in a heat exchanger having a shell that extends along a longitudinal axis and surrounds a shell space for receiving a first fluid, wherein the heat exchanger also has a bundle of tubes arranged in the shell space and comprising a plurality of tubes for receiving at least one second fluid, which form a number of tube layers, and a shroud arranged in the shell space and which encloses an outermost tube layer of the bundle of tubes in the radial direction of the bundle of tubes, wherein spacers that are made to extend along the longitudinal axis are arranged between the shroud and the outermost tube layer, wherein between every two spacers adjacent to one another in the circumferential direction of the shroud and the shroud and the outermost tube layer there is an intermediate space, said method comprising pushing a flow obstacle into the respective intermediate space, wherein said flow obstacle is designed to hinder or suppress a flow of the first fluid in the respective intermediate space at least over a partial portion of the respective intermediate space that extends along the longitudinal axis, wherein each flow obstacle comprises a flexible layer of material, and wherein each intermediate space has a cross-sectional area perpendicularly to the longitudinal axis and a length along the direction of the longitudinal axis, and wherein, along the length in the direction of the longitudinal axis the respective flow obstacle takes up over 50% of the cross-sectional area of the intermediate space.

18. The method as claimed in claim 17, wherein the respective flow obstacle has a supporting structure with an upper edge, around which the flexible layer of material is placed, so that a portion of the flexible layer of material surrounds said upper edge, wherein the respective flow obstacle is pushed or guided into the respective intermediate space from below beginning with said portion.

* * * * *